US010844870B2

(12) United States Patent
Kim et al.

(10) Patent No.: US 10,844,870 B2
(45) Date of Patent: Nov. 24, 2020

(54) AIR CLEANER

(71) Applicant: Samsung Electronics Co., Ltd., Gyeonggi-do (KR)

(72) Inventors: Jin Baek Kim, Hwaseong-si (KR); Seong Hyun Yoon, Seoul (KR); Dong Gi Han, Seoul (KR); Eung Ryeol Seo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 274 days.

(21) Appl. No.: 15/709,383

(22) Filed: Sep. 19, 2017

(65) Prior Publication Data

US 2018/0080457 A1 Mar. 22, 2018

(30) Foreign Application Priority Data

Sep. 19, 2016 (KR) ..... 10-2016-0119209

(51) Int. Cl.

| | |
|---|---|
| ***F04D 29/32*** | (2006.01) |
| ***F04D 29/28*** | (2006.01) |
| ***F04D 25/08*** | (2006.01) |
| ***F04D 29/26*** | (2006.01) |
| *F04D 29/02* | (2006.01) |

(Continued)

(52) U.S. Cl.

CPC ..... *F04D 29/329* (2013.01); *F04D 25/08* (2013.01); *F04D 29/263* (2013.01); *F04D 29/282* (2013.01); *F04D 29/023* (2013.01); *F04D 29/20* (2013.01); *F04D 29/40* (2013.01);

(Continued)

(58) Field of Classification Search

CPC ..... F04D 25/08; F04D 29/023; F04D 29/20; F04D 29/263; F04D 29/282; F04D 29/329; F04D 29/40; F04D 29/668; F05D 2300/43; F05D 2300/501

See application file for complete search history.

(56) References Cited

U.S. PATENT DOCUMENTS 7,878,772 B2 * 2/2011 Rexhauser ..... F04D 19/022 417/313
8,668,458 B2 * 3/2014 Cho ..... F04D 29/023 416/204 R (Continued)

FOREIGN PATENT DOCUMENTS

CN 104047724 A 9/2014
CN 105134629 A 12/2015

(Continued)

OTHER PUBLICATIONS

Office Action dated Jan. 17, 2020 in connection with Chinese Patent Application No. 201710846293.9, 14 pages.

*Primary Examiner* — Carl C Staubach

(57) ABSTRACT

Disclosed is an air cleaner having an improved boss for increasing rigidity. The air cleaner includes a main body, a blowing fan provided inside the main body, a motor for driving the blowing fan and a boss provided to connect the blowing fan and the motor. The boss includes a first metallic member connected to the blowing fan, a second metallic member connected to the motor, and an elastic member provided between the first metallic member and the second metallic member. At least one of the first metallic member and the second metallic member includes a contact increasing portion configured to increase a contact area with the elastic member.

20 Claims, 13 Drawing Sheets

(51) Int. Cl.
*F04D 29/20* (2006.01)
*F04D 29/40* (2006.01)
*F04D 29/66* (2006.01)

(52) U.S. Cl.
CPC ..... *F04D 29/668* (2013.01); *F05D 2300/43* (2013.01); *F05D 2300/501* (2013.01)

(56) References Cited

U.S. PATENT DOCUMENTS

| | | | | |
|---|---|---|---|---|
| 9,388,731 | B2 | 7/2016 | Le Roy et al. | |
| 2006/0187597 | A1 | 8/2006 | Onezawa et al. | |
| 2010/0014995 | A1* | 1/2010 | Lee | F04D 29/263 417/354 |
| 2011/0229341 | A1* | 9/2011 | Andrejco | F04D 19/002 416/244 R |
| 2012/0027571 | A1* | 2/2012 | Cho | F04D 29/023 415/119 |

FOREIGN PATENT DOCUMENTS

| | | | | |
|---|---|---|---|---|
| JP | 2012092810 | A | * | 5/2012 |
| KR | 2006008910 | A | | 7/2006 |
| KR | 20100030182 | A | | 3/2010 |
| KR | 20120012665 | A | | 2/2012 |

* cited by examiner

AIR CLEANER

CROSS-REFERENCE TO RELATED APPLICATIONS

This application claims the priority benefit of Korean Patent Application No. 10-2016-0119209, filed on Sep. 19, 2016, in the Korean Intellectual Property Office, the disclosure of which is incorporated herein by reference.

TECHNICAL FIELD

The present disclosure relates to an air cleaner, and more particularly, to an air cleaner having an improved boss for increasing rigidity.

BACKGROUND

Air cleaners are devices that are installed indoors to filter dust in the air or to sterilize the air.

Generally, an air cleaner includes a main body, a blowing fan provided inside the main body to suction outside air into the main body and then discharge the air to the outside of the main body, and a motor for driving the blowing fan.

The main body includes a suction port for suctioning air outside the main body into the main body and a discharge port for discharging the air suctioned into the main body to the outside of the main body. The air suctioned through the suction port is discharged through the discharge port after being cleaned by the filter.

The blowing fan is disposed in the air passage connecting the suction port and discharge port in the main body, and is driven by the motor.

The motor is provided so as to rotate with a drive shaft coaxial with the rotation center of the blowing fan. The motor and the blower fan are connected by a boss.

SUMMARY

Therefore, it is an aspect of the present disclosure to provide an air cleaner having a boss improved to increase rigidity.

It is another aspect of the present disclosure to provide an air cleaner having a boss capable of improving the coupling and durability of a fan and a motor.

It is another aspect of the present disclosure to provide an air cleaner capable of reducing rotational vibration of a fan and reducing unsteadiness due to an external impact, thereby improving convenience of a user and stability of the product.

Additional aspects of the disclosure will be set forth in part in the description which follows and, in part, will be obvious from the description, or may be learned by practice of the present disclosure.

In accordance with an aspect of the present disclosure, an air cleaner includes a main body, a blowing fan provided inside the main body, a motor configured to drive the blowing fan and a boss configured to connect the blowing fan and the motor. The boss includes a first metallic member connected to the blowing fan, a second metallic member connected to the motor, and an elastic member provided between the first metallic member and the second metallic member. At least one of the first metallic member and the second metallic member includes a contact increasing portion configured to increase a contact area with the elastic member.

The elastic member may be injection-molded between the first metallic member and the second metallic member.

The contact increasing portion may include a first contact increasing portion integrally formed with the first metallic member.

The contact increasing portion may further include a plurality of holes, and the elastic member may be injection-molded through the plurality of holes.

The first contact increasing portion may include at least one bent portion protruding toward the motor.

The first contact increasing portion may include a ring-shaped protrusion in which at least a portion of the first metallic member protrudes toward the motor.

The protrusion may include a plurality of holes.

The contact increasing portion may include a second contact increasing portion integrally formed with the second metallic member.

One side of the upper and lower sides of the second contact increasing portion may have a larger diameter than the other side.

The first metallic member and the second metallic member may include aluminum.

The boss may be coupled to the blowing fan by injection molding.

In accordance with another aspect of the present disclosure, an air cleaner includes a main body, a blowing fan provided inside the main body, a motor configured to drive the blowing fan, and a boss provided in the blowing fan to be connected to the motor. The boss includes a first metallic member having a first contact increasing portion protruding toward the motor, a second metallic member connected to the motor and having a second contact increasing portion protruding in a circumferential direction and an elastic member provided between the first metallic member and the second metallic member.

The elastic member may be injection-molded between the first metallic member and the second metallic member.

The first contact increasing portion may include a bent portion in which at least a portion of the first metallic member is bent and protrudes toward the motor, and a plurality of holes formed through the bent portion. The elastic member may be injection-molded with the first metallic member through the plurality of holes.

The first contact increasing portion may include a ring-shaped protrusion in which at least a portion of the first metallic member protrudes toward the motor.

The protrusion may include a plurality of holes.

One side of the upper and lower sides of the second contact increasing portion may have a larger diameter than the other side.

The composition of the first metallic member and the second metallic member may include aluminum.

The second metallic member may further include a motor connecting portion to which the motor is connected, the second contact increasing portion protruding outside the motor connecting portion.

The boss may be coupled to the blowing fan by injection molding.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
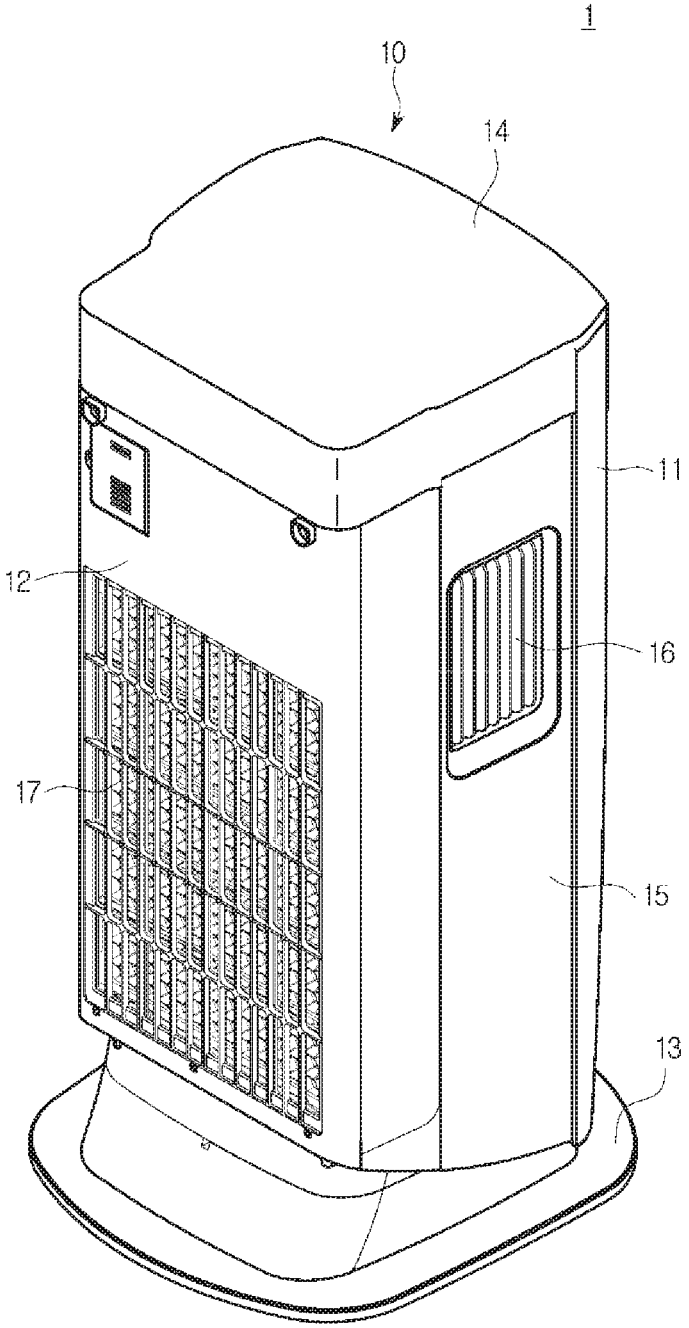
FIG. 1 is a perspective view illustrating an air cleaner according to an embodiment of the present disclosure.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification indicate elements or components that perform the substantially same functions.

Also, the terms used in the present specification are for describing embodiments and not for limiting or restricting the present disclosure. It is to be understood that the singular forms "a," "an," and "the" include plural referents unless the context clearly dictates otherwise. It will be understood that the terms "includes," "comprises," "including," and/or "comprising," when used in this specification, specify the presence of stated features, figures, steps, components, or combination thereof. Therefore, they do not preclude the presence or addition of one or more other features, figures, steps, components, members, or combinations thereof.

It will be understood that, although the terms first, second, etc. may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

Hereinafter, exemplary embodiments according to the present disclosure will be described in detail with reference to the accompanying drawings.

The term "front" used in the following description refers to the forward direction with reference to the air cleaner 1 shown in FIG. 1, and the term "rear" refers to the rearward direction of the air cleaner 1.

Figure 2:
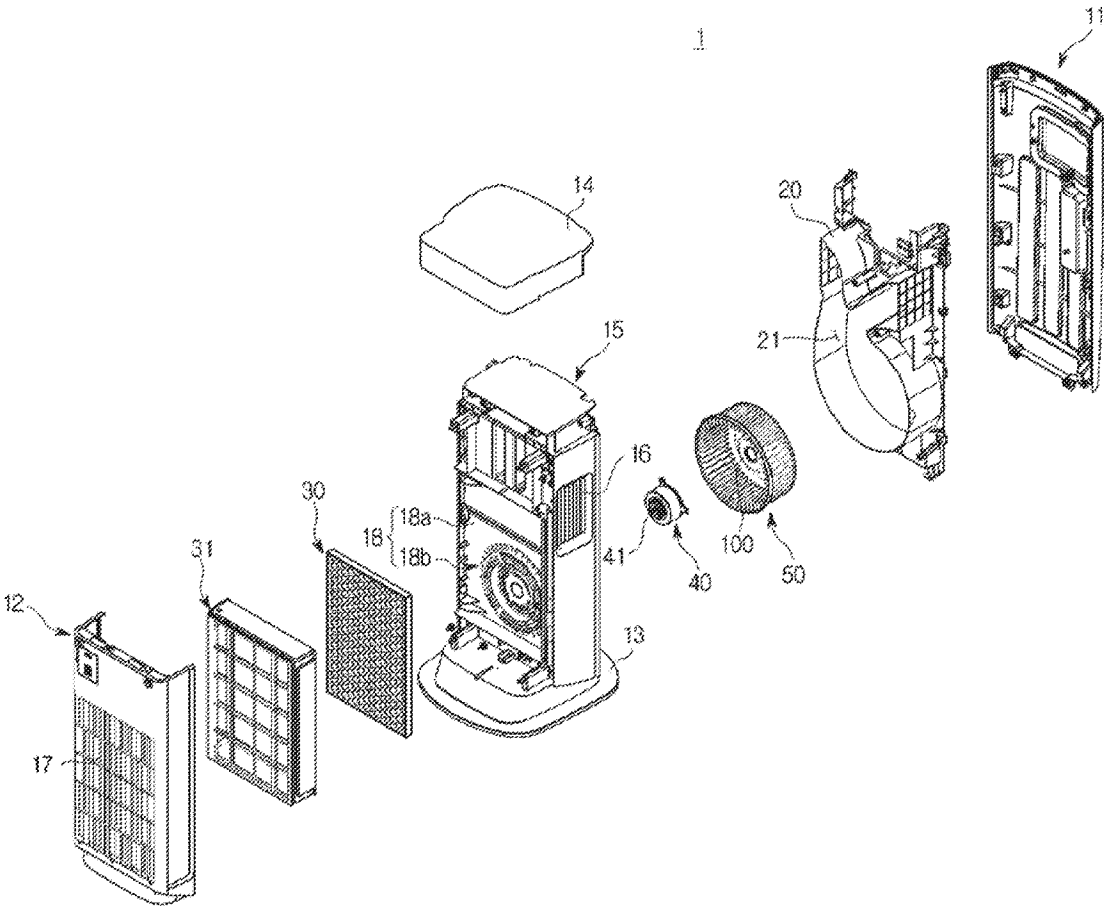
FIG. 2 is an exploded perspective view of the air cleaner according to the embodiment of the present disclosure.
Figure 3:
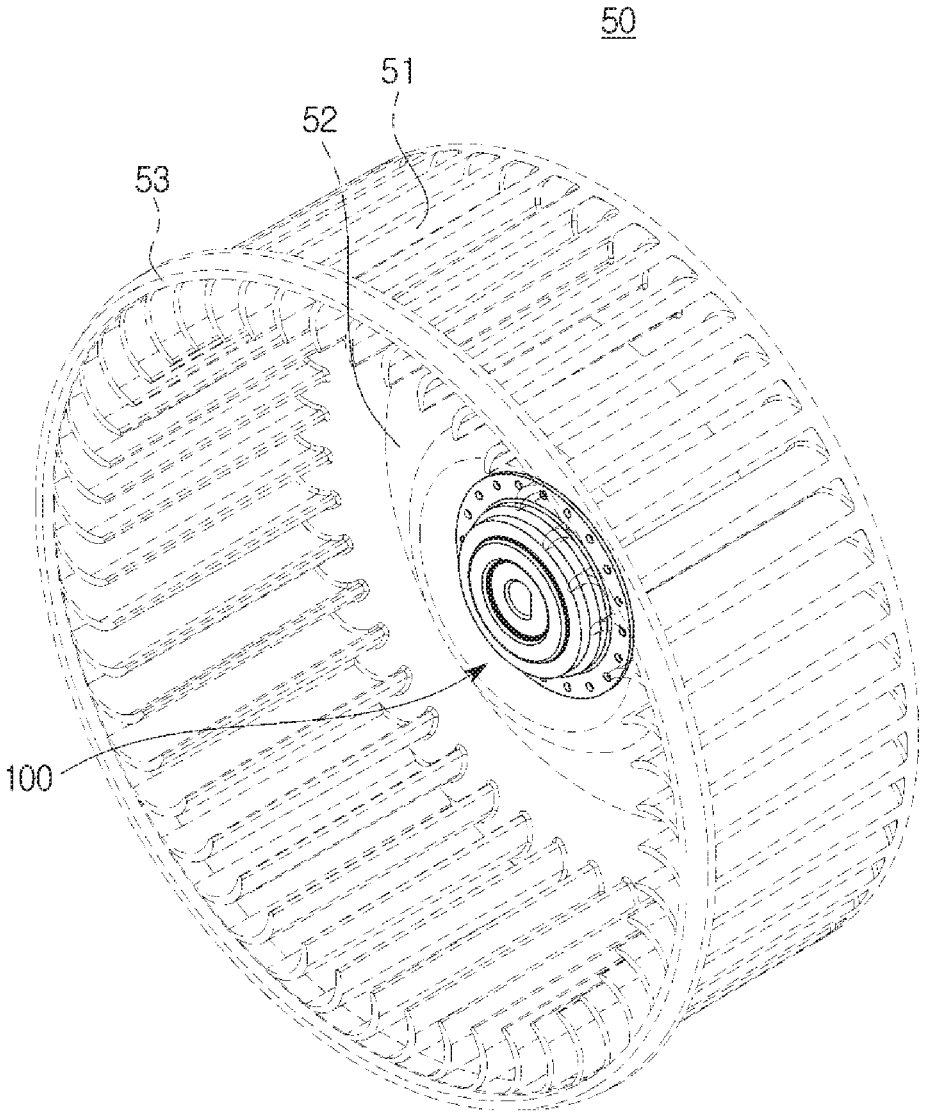
FIG. 3 is a perspective view illustrating a blowing fan of the air cleaner according to the embodiment of the present disclosure.

FIG. 1 is a perspective view illustrating an air cleaner according to an embodiment of the present disclosure, FIG. 2 is an exploded perspective view of the air cleaner according to an embodiment of the present disclosure, and FIG. 3 is a perspective view illustrating a blowing fan of the air cleaner according to an embodiment of the present disclosure.

As illustrated in FIGS. 1 to 3, an air cleaner 1 includes a main body 10 forming an outer appearance, a filter member 30 provided inside the main body 10 to filter dust from air suctioned inward frog the outside of the main body 10 or to sterilize the air, a blowing fan 50 provided inside the main body 10 to suction air into the main body 10 or discharge air to the outside the main body 10, and a motor 40 configured to drive the blowing fan 50.

The main body 10 includes a case 15, a front panel 11 provided in front of the case 15 to form a front surface, a rear panel 12 provided behind the case 15 to form a rear surface, a upper panel 14 provided on the case 15 so as to form an upper surface and a base 13 provided below the case 15 form a lower surface.

A suction port 17 may be formed in the rear panel 12 to allow air to flow into the main body 10. A discharge port 16 may be formed in the case 15 so that air is discharged to the outside of the main body 10. Discharge ports 16 may be formed on the opposite sides of the case 15, respectively. Although the suction port is formed on the rear panel and the discharge port is formed on the opposite sides of the case in the embodiment of the present disclosure, the spirit of the present disclosure is not limited thereto. For example, the discharge port and the suction port may be formed at different positions.

The case 15 may include a case frame 18 for accommodating the blowing fan 50 and the motor 40 therein. The case 15 elude a duct 20 in which a guide passage 21 for guiding the air suctioned through the suction port 17 to the discharge port 16 is formed.

The case frame 18 is provided with a partition wall 18*a* and the partition wall 18*a* may be provided with a fan guard 18*b* for guiding the air suctioned through the suction port 17 to the blowing fan 50.

The duct 20 is disposed between the case 15 and the front panel 11. The duct 20 may include a guide passage 21 for guiding air so that the air suctioned by the suction port 17 and passed through the blowing fan 50 is discharged to the discharge port 16.

The rear panel 12 is disposed on the rear surface of the case 15. In the rear panel 12, a suction ort 17 for suctioning air outside the main body 10 into the main body 10 is formed. The suction port 17 may include a plurality of holes or slits.

A filter member 30 is provided between the case 15 and the rear panel 12 to filter or sterilize foreign matter from the air suctioned through the suction port 17. The filter member 30 may be fixed by a filter member fixing portion 31 coupled to the rear panel 12.

The filter member 30 may optionally include a pre-filter, an electrostatic filter of an electrical dust precipitating type, a non-woven fine dust filter made of polypropylene resin or polyethylene resin, and a granular activated carbon filter. The filters may be arranged to form a layer.

The duct 20, the blowing fan 50 and the motor 40 are disposed in a space between the partition wall 18*a* and the front panel 11. The filter member 30 is disposed in a space between the partition wall 18*a* and the rear panel 12.

The blowing fan 50 is disposed inside the main body 10 and may be disposed in the guide passage 21 of the duct 20. The blowing fan 50 causes air to be suctioned into the main body 10 or discharged to the outside. In the embodiment of the present disclosure, the blowing fan 50 is a sirocco fan having a discharge direction that is perpendicular to a suction direction, but the spirit of the present disclosure is not limited thereto.

The motor 40 drives the blowing fan 50 and is provided so as to rotate about the same rotational axis as the rotational renter of the blowing fan 50.

The blowing fan 50 has a circular plate. The blowing fan 50 may have a main plate 52 to which a rotation shaft 41 of the motor 40 is coupled, a plurality of blades 51 provided around the main plate 52, and a rim 53 connecting edges of the plurality of blades 51.

A boss 100 for connecting to the rotation shaft 41 of the motor 40 may be provided at the center of the main plate 52.

Figure 4:
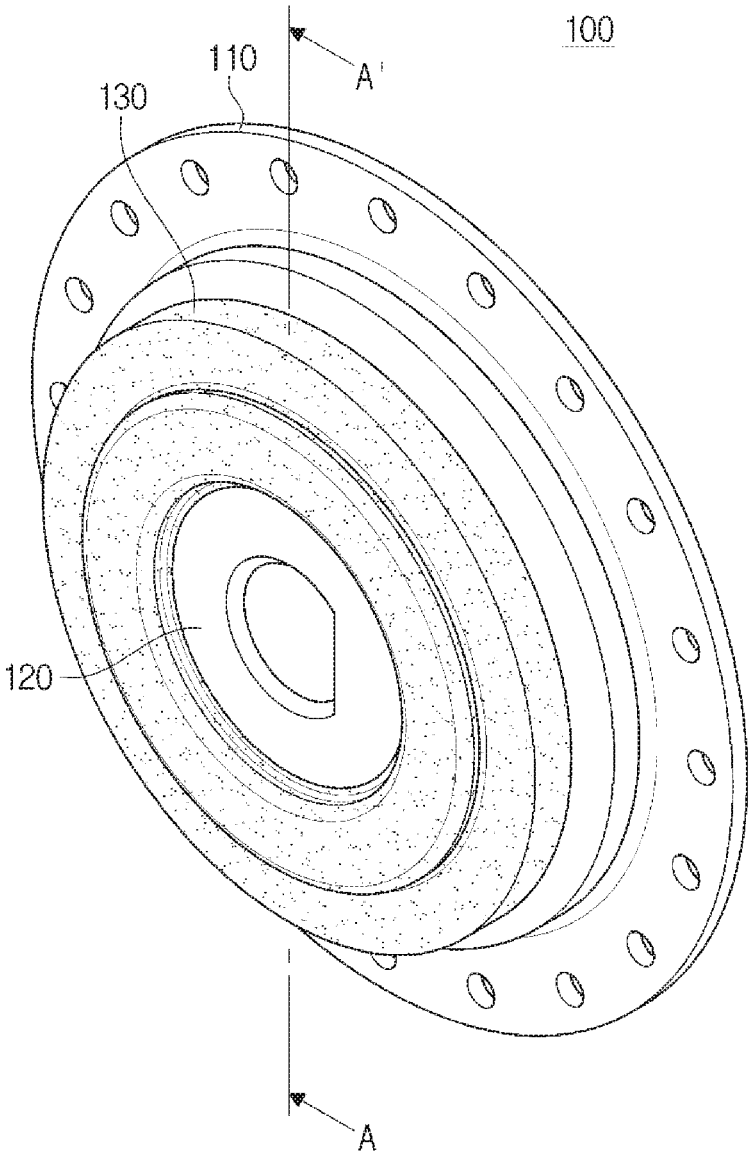
FIG. 4 is a perspective view illustrating a boss of the blowing fan according to the embodiment of the present disclosure.
Figure 5:
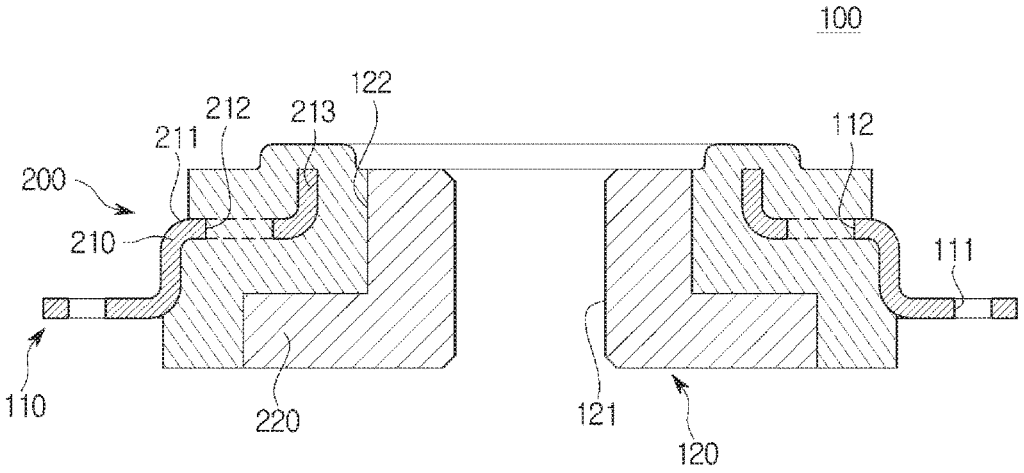
FIG. 5 is a cross-sectional view taken along the line A-A' in FIG. 4.
Figure 6:
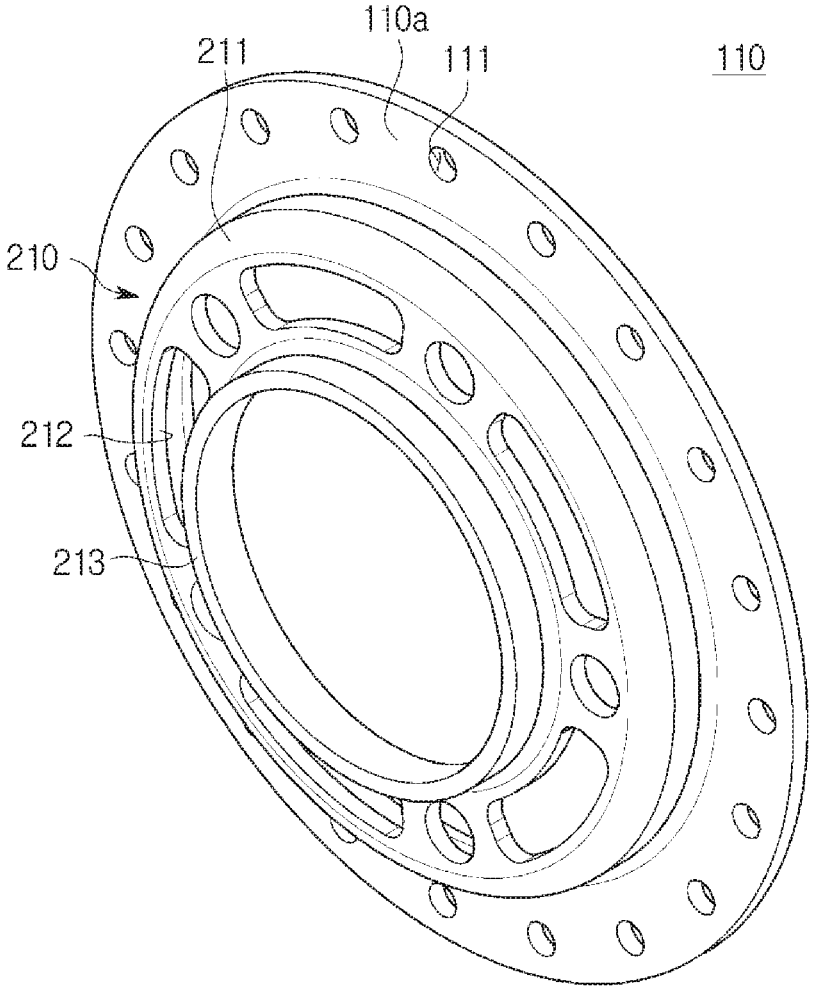
FIG. 6 is a perspective view illustrating a first metallic member of the boss according to the embodiment of the present disclosure.
Figure 7:
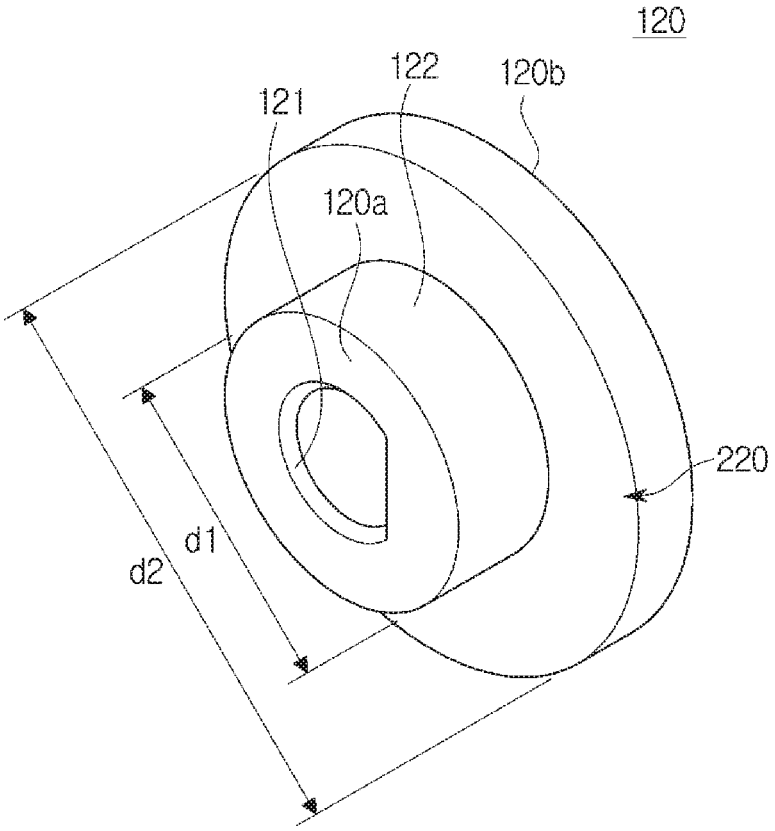
FIG. 7 is a perspective view illustrating a second metallic member of the boss according to the embodiment of the present disclosure.

FIG. 4 is a perspective view illustrating a boss of the blowing fan according to the embodiment of the present disclosure, FIG. 5 is a cross-sectional view taken along the line A-A' in FIG. 4. FIG. 6 is a perspective view illustrating a first metallic member of the boss according to the embodiment of the present disclosure, and FIG. 7 is a perspective view illustrating a second metallic member of the boss according to the embodiment of the present disclosure.

As illustrated in FIGS. 4 to 7, the boss 100 provided at the center of the blowing fan 50 connects the blowing fan 50 and the motor 40. The boss 100 is coupled to the motor 40 so as to connect the blowing fan 50 and the motor 40.

The boss 100 includes a first metallic member 110, a second metallic member 120, and an elastic member 130. The first metallic member 110, the second metal member 120, and the elastic member 130 may be injection-molded such that the boss 100 is integrally formed. The elastic member 130 is configured to prevent noise and vibration when the motor 40 rotates.

The first metallic member 110 and the second metallic member may include aluminum. The elastic member 130 may include, a rubber material. The elastic member 130 may be formed by being injection-molded between the first metallic member 110 and the second metallic member 120. The first metallic member 110 and the second metallic member 120 may include contact increasing portions 200 configured to increase contact areas with the elastic member 130. At least one of the first metallic member 110 and the second metallic member 120 may form the contact increasing portion 200. At least one of the first metallic member 110 and the second metallic member 120 may include at least one contact increasing portion 200.

The first metallic member 110 may have a circular plate. The first metallic member 110 may include a first contact increasing portion 210. The first metallic member 110 may include a circular first metallic member body 110*a*. A blowing fan connection hole 111 for connection with the blowing fan 50 may be formed on the outer side of the circular first metallic member body 110*a*. A plurality of blowing fan connection holes 111 may be formed. The plurality of blowing fan connection holes 111 may be spaced apart from each other by a predetermined distance in a circumferential direction of the first metallic member body 110*a*.

The first contact increasing portion 210 of the first metallic member 110 may be formed by bending the center portion of the first metallic member body 110*a* toward the motor 40. The first contact increasing portion 210 may include a first bent portion 211 formed by protruding the center portion of the first metallic member 110 from the first metallic member body 110*a* the motor 40. The first contact increasing portion 210 may be formed integrally with the first metallic member 110.

A plurality of holes 112 and 212 may be formed in the first bent portion 211. The plurality of holes 212 formed in the first bent portion 211 may be spaced apart from each other by a predetermined distance. The plurality of holes 212 may include slots. A shear force is generated through the elastic member 130 which is injection-molded through the plurality of holes 212 and the damping force of the elastic member 130 is improved to prevent noise or vibration.

Meanwhile, a part of the first bent portion 211 of the first contact increasing portion 210 may be exposed to the outside of the elastic member 130. The first contact increasing portion 210 may include at least one bent portion 211. The first metallic member 110 may include a second bent portion 213 formed at the center of the first metallic member 110 and bent from the first bent portion 211 toward the motor 40. The second bent portion 213 is provided to increase the contact area with the elastic member 130 and to maintain the gap with the second metallic member 120. The second bent portion 213 can improve the rigidity of the boss 100.

The second metallic member 120 includes a second metallic member body 122 having a motor coupling portion 121 to which the rotation shaft 41 of the motor 40 is coupled. The second metallic member body 122 is formed in a cylindrical shape. The motor coupling portion 121 is passed through the second metallic member body 122 so as to correspond to the rotation shaft 41 of the motor 40 so that the rotation shaft 41 is coupled to the center of the second metallic member body 122.

The second metallic member body 122 may include a cylindrical portion having a first diameter d1. The second metallic member body 122 may include a second contact increasing portion 220 configured to increase the contact area with the elastic member 130. The second contact increasing portion 220 of the second metallic member 120 may be formed as an outward protrusion on the lower portion of the second metallic member body 122. The second contact increasing portion 220 has a second diameter d2. The second diameter d2 of the second contact increasing portion 220 may be larger than the first diameter d1. The second contact increasing portion 220 may be integrally formed with the second metallic member 120.

The second metallic member body 122 may include an upper surface 120*a* formed on a side to which the motor 40 is connected and a lower surface 120*b* formed on a side to which the blowing fan 50 is connected. The upper surface 120*a* may have the first diameter d1 and the lower surface 120*b* may have the second diameter d2.

The first metallic member 110 and the second metallic member 120 are spaced apart from each other by the first contact increasing portion 210 and the second contact increasing portion 220. By increasing the contact area with the elastic member 130 to be injection-molded in a space between the first metallic member 110 and the second metallic member 120, the movement of the blowing fan 50 can be reduced, and vibration and noise can be reduced.

Figure 8:
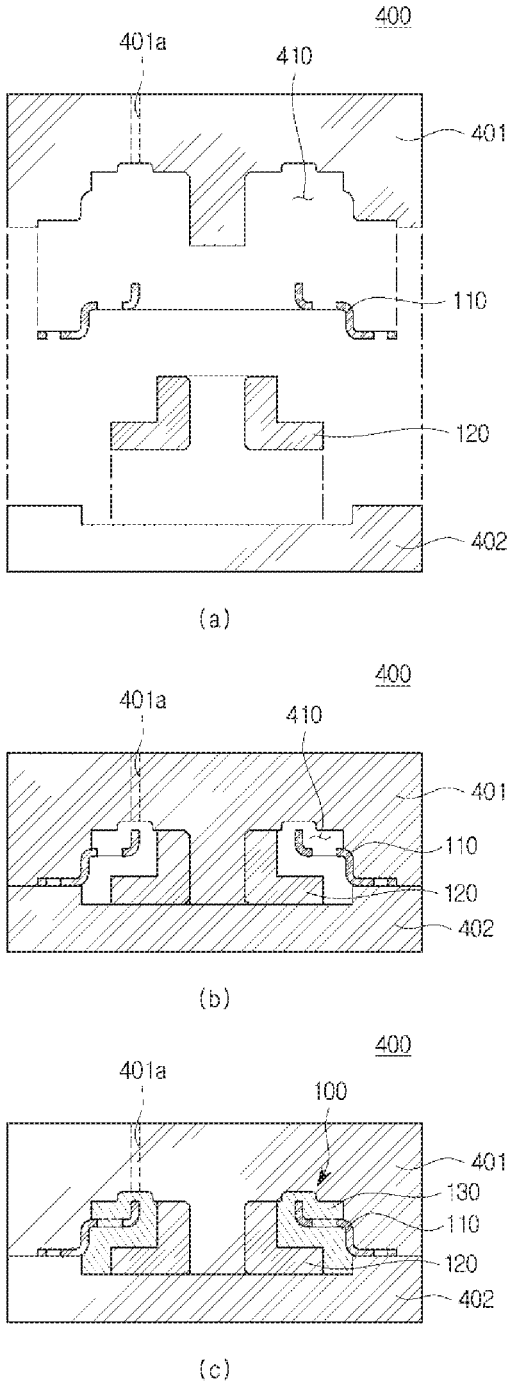
FIG. 8 is a view illustrating a method of manufacturing the boss according to the embodiment of the present disclosure.
Figure 9:
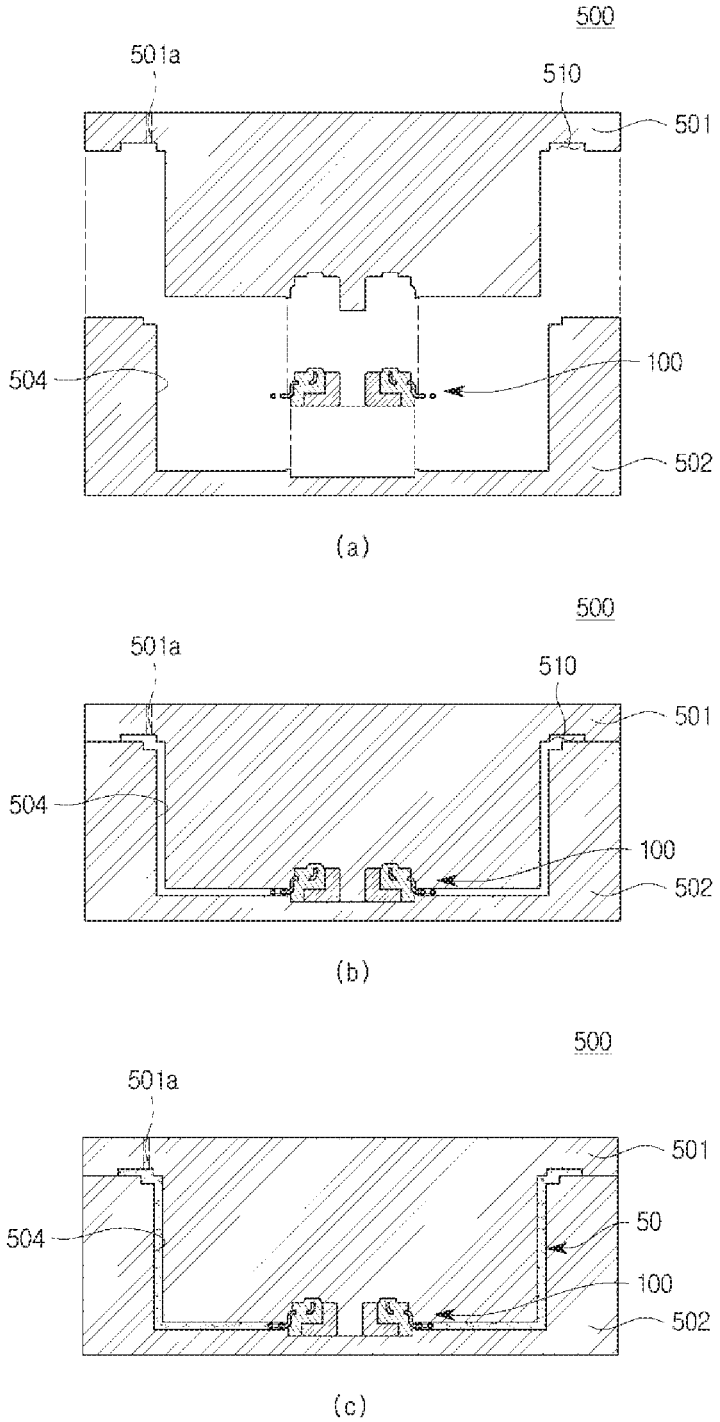
FIG. 9 is a view illustrating a method of manufacturing the blowing fan according to the embodiment of the present disclosure.

FIG. 8 is a view illustrating a method of manufacturing the boss according to the embodiment of the present disclosure, and FIG. 9 is a view illustrating a method of manufacturing the blowing fan according to the embodiment of the present disclosure.

A method of manufacturing the boss 100 will be schematically described with reference to FIG. 8

A mold 400 includes an upper mold 401 and a lower mold 402. The first metallic member 110 and the second metallic member 120 are disposed in a cavity 410 formed between the upper mold 401 and the lower mold 402.

The first metallic member 110 includes the first contact increasing portion 210 and the second metallic member 120 includes the second contact increasing portion 220.

The cavity 410 may have a shape corresponding to the shape of the elastic member 130, which is injection-molded between the first metallic member 110 and the second metallic member 120. The first metallic member 110 is positioned on the upper side and the second metallic member 120 is positioned on the lower side. Although the first metallic member 110 corresponds to the upper mold 401 and the second metallic member 120 corresponds to the lower mold 402 in the embodiment of the present disclosure, the spirit of the present disclosure is not limited thereto.

When the first metallic member 110 and the second metallic member 120 are disposed in the upper mold 401 and the lower mold 402 respectively, molten rubber injected into the cavity 410 and the rubber is solidified so that the boss 100 in which the elastic member 130 is injection-molded between the first metallic member 110 and the second metallic member 120 is manufactured. Although an injection port 401*a* for injecting molten rubber into the cavity is formed in the upper mold 401 in the embodiment of the present disclosure, the spirit of the present disclosure is not limited thereto. For example, the injection port may be formed in the lower mold.

A method of manufacturing the blowing fan 50 having the boss 100 will be schematically described with reference to FIG. 9.

A mold 500 for injection-molding the blowing fan 50 includes an upper mold 501 and a lower mold 502. The boss 100 is disposed inside a cavity 510 formed between the upper mold 501 and the lower mold 502.

The cavity 510 may have a molding portion 504 for forming the blowing fan 50.

The injection-molded boss 100 is placed in the cavity 510 between the upper mold 501 and the lower mold 502. When the boss 100 is disposed in the cavity 510, molten resin is injected into the cavity 510 and the resin is solidified according to the shape of the molding portion 504 so that the blowing fan 50 in which the boss 100 is disposed at the center of the blowing fan 50 is manufactured. Although an injection port 501*a* for injecting the molten resin into the cavity is formed in the upper mold 501 in the embodiment of the present disclosure, the spirit of the present disclosure is not limited thereto. For example, the injection port may be formed in the lower mold.

Figure 10:
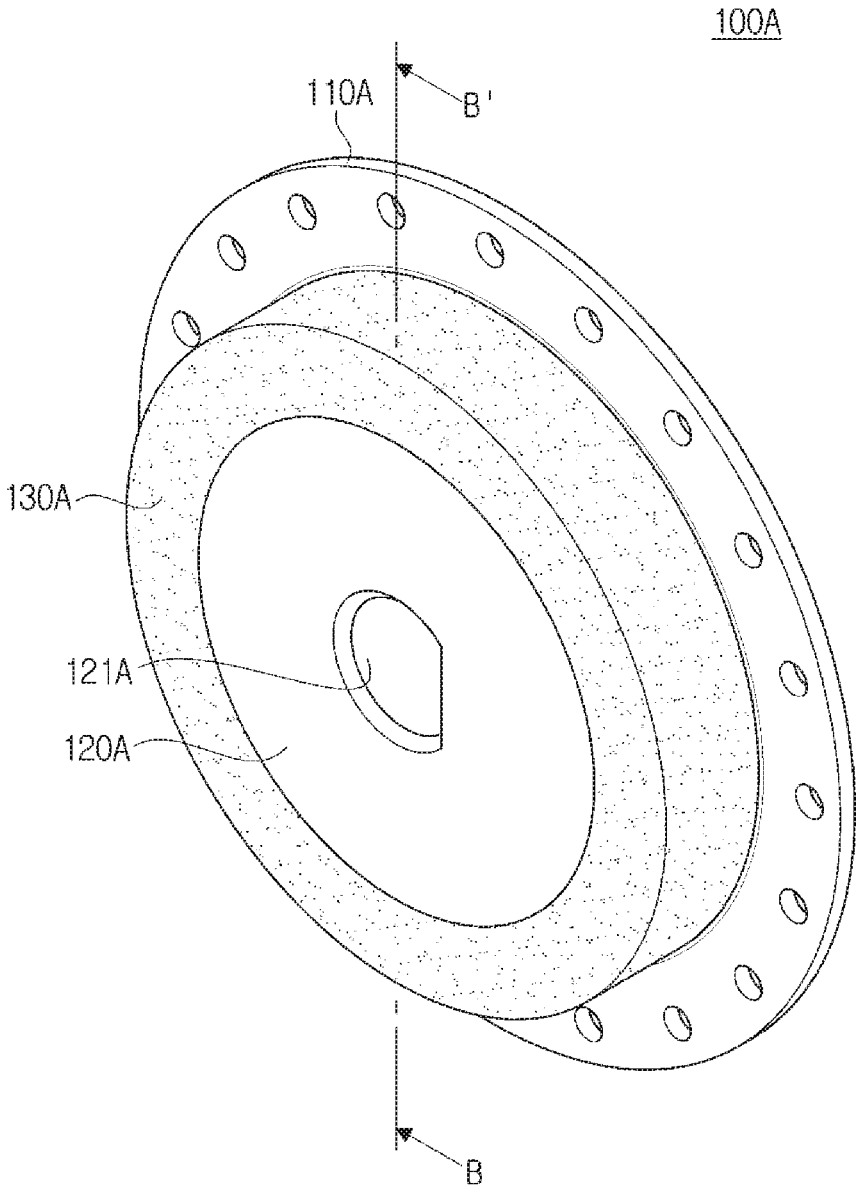
FIG. 10 is a perspective view illustrating boss of a blowing fan of an air cleaner according to another embodiment of the present disclosure.
Figure 11:
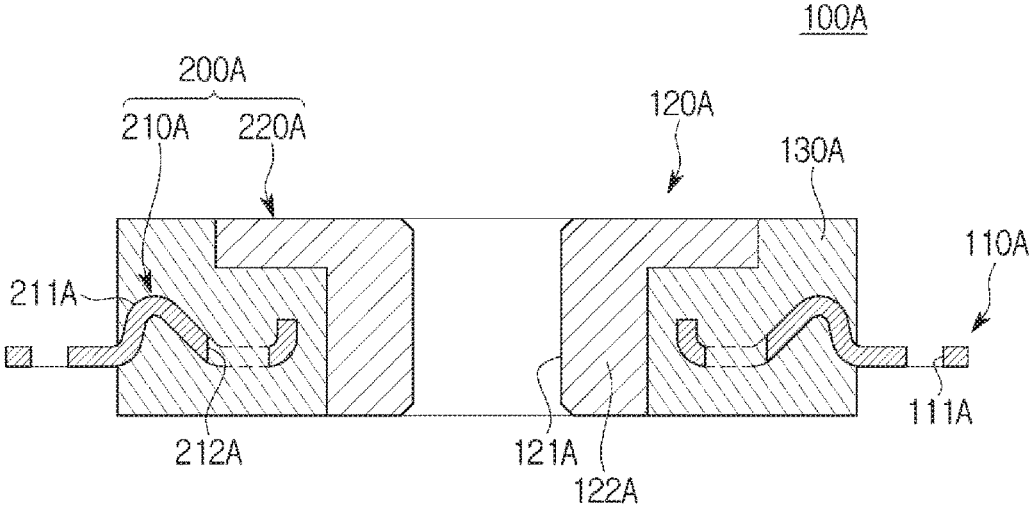
FIG. 11 is a cross-sectional view taken along the line B-B in FIG. 10.
Figure 12:
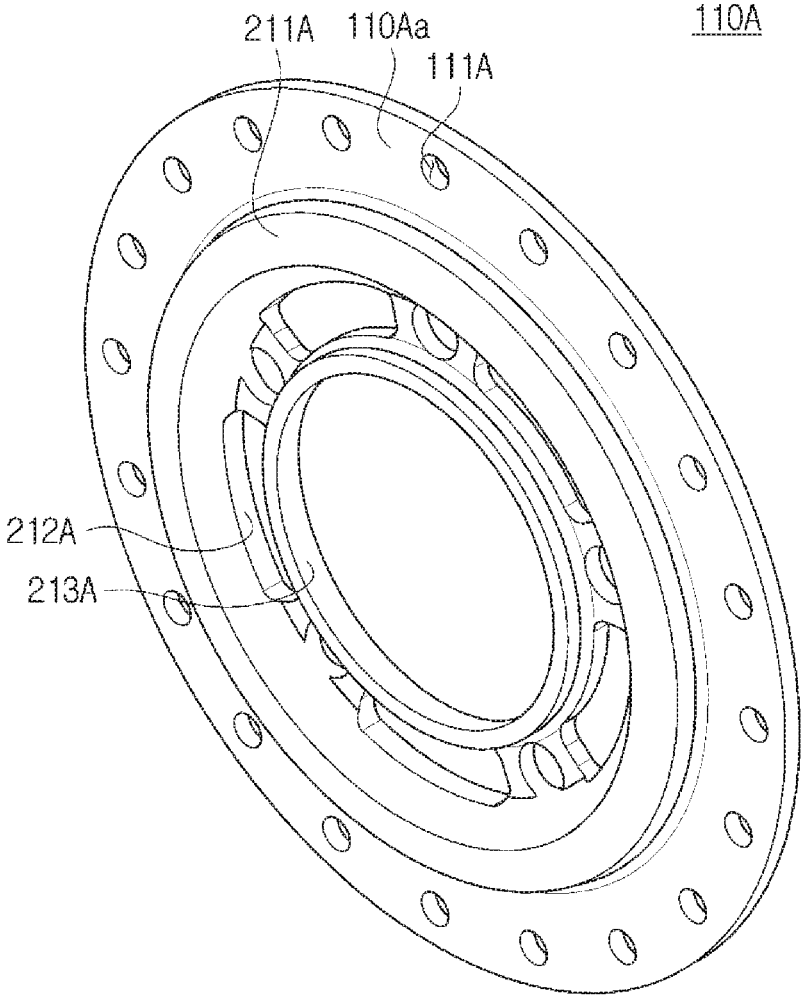
FIG. 12 is a perspective view illustrating a first metallic member of the boss according to another embodiment of the present disclosure.
Figure 13:
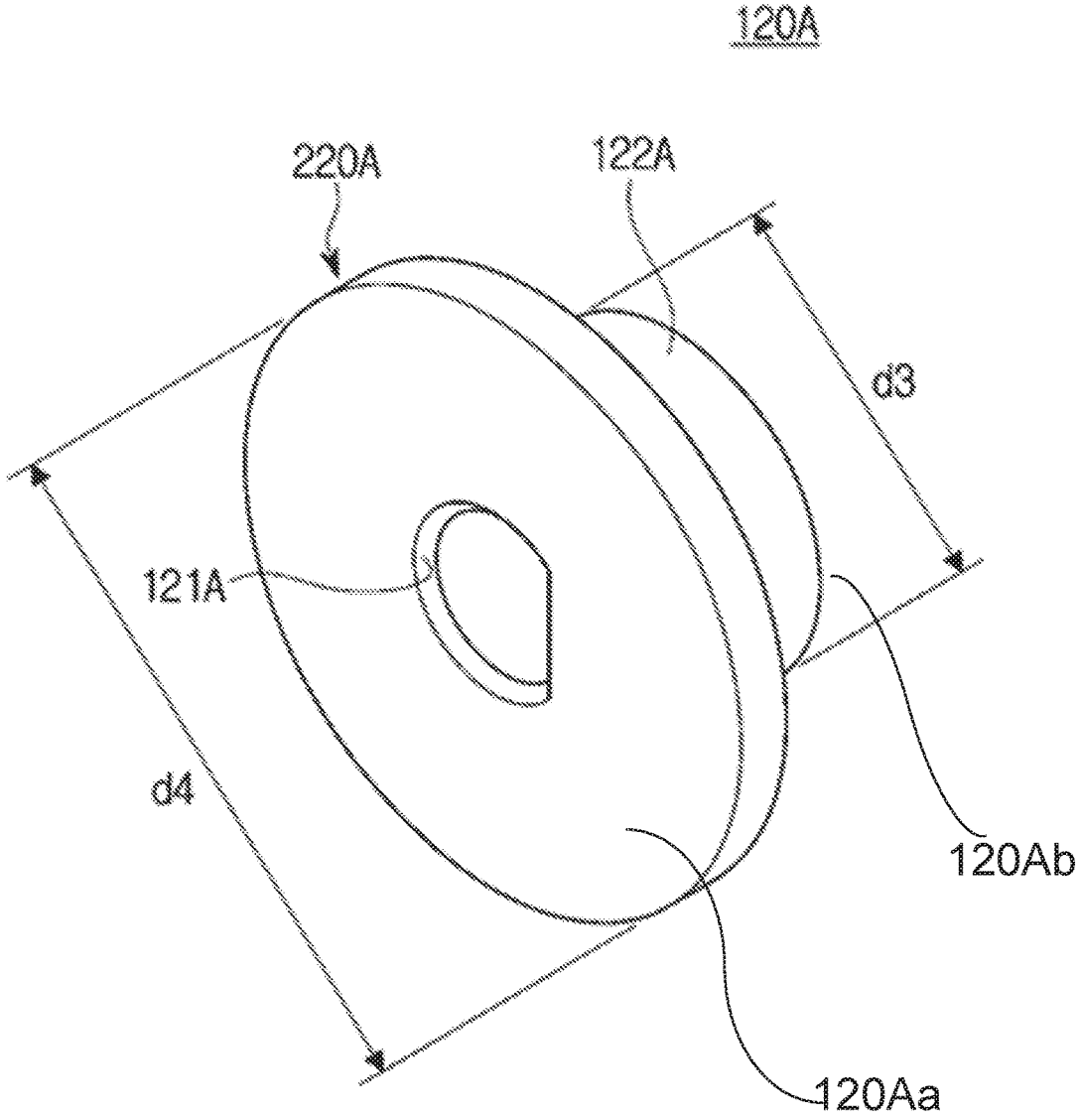
FIG. 13 is a perspective view illustrating a second metallic member of the boss according to another embodiment of the present disclosure.

FIG. 10 is a perspective view illustrating a boss of a blowing fan of an air cleaner according to another embodiment of the present disclosure. FIG. 11 is a cross-sectional view taken along the line B-B' in FIG. 10, FIG. 12 is a perspective view illustrating a first metallic member of the boss according to another embodiment of the present disclosure, and FIG. 13 is a perspective view illustrating a second metallic member of the boss according to another embodiment of the present disclosure. Reference numerals not shown refer to FIGS. 1 to 9.

As illustrated in FIGS. 10 to 13, a boss 100A of a blowing fan 50 includes a first metallic member 110A, a second metallic member 120A, and an elastic member 130A. The boss 100A may be integrally formed by injection-molding the first metallic member 110A, the second metallic member 120A, and the elastic member 130A.

The first metallic member 110A and the second metallic member 120A may include aluminum. The elastic member 130A may include a rubber material. The elastic member 130A may be formed between the first metallic member 110A and the second metallic member 120A by injection molding. The first metallic member 110A and the second metallic member 120A may include a contact increasing portion 200A configured to increase the contact area with the elastic member 130A.

The first metallic member 110A may include a circular plate. The first metallic member 110A may include a first contact increasing portion 210A. The first metallic member 110A may include a circular first metallic member body 110Aa. A blowing fan connection hole 111A for connection with the blowing fan 50 may be formed on the outer circumference of the circular first metallic member body 110Aa. The first metallic member body 110Aa may include a plurality of blowing fan connecting holes 111A. The plurality of blowing fan connection holes 111A may be spaced apart from each other around the outer circumference of the first metallic member body 110Aa.

The first contact increasing portion 210A of the first metallic member 110A may include a ring-shaped protrusion 211A in which a portion of the first metallic member body 110Aa protrudes in a circumferential direction. The protrusion 211A may protrude from the first metallic member body 110Aa toward the motor 40. The first contact increasing portion 210A may be formed integrally with the first metallic member 110A.

A plurality of holes 212A may be formed in the protrusion 211A. The plurality of holes 212A formed at one side of the protrusion 211A may be spaced apart from each other by a predetermined distance in the circumferential direction. The plurality of holes 212A may include slots. A shear force is generated through the elastic member 130A which is injection-molded through the plurality of holes 212A and the damping force of the elastic member 130A is improved to prevent noise or vibration.

The protrusion 211A of the contact increasing portion 210A and the plurality of holes 212A may increase the contact area with the elastic member 130.

The second metallic member 120A includes a second metallic member body 122A having a motor coupling portion 121A to which the rotation shaft 41 of the motor 40 is coupled. The second metallic member body 122A has a cylindrical shape. The motor coupling portion 121A is passed through the second metallic member body 122A so as to correspond to the rotation shaft 41 of the motor 40 so that the rotation shaft 41 is coupled to the center of the second metallic member body 122A.

The second metallic member body 122A may include a cylindrical shape having a third diameter d3. The second metallic member body 122A may include a second contact increasing portion 220A configured to increase the contact area with the elastic member 130A. The second contact increasing portion 220A of the second metallic member 120A may be formed by protruding the lower portion of the second metallic member body 122A outward. The second contact increasing portion 220A has a fourth diameter d4. The fourth diameter d4 of the second contact increasing portion 220A may be larger than the third diameter d3. The second contact increasing portion 220A may be integrally formed with the second metallic member 120A.

The second metallic member body 122A may include an upper surface 120Aa formed on a side to which the motor 40 is connected and a lower surface 120Ab formed on a side to which the blowing fan 50 is connected. The upper surface 120Aa may have the fourth diameter d4 and the lower surface 120Ab may have the third diameter d3.

The first metallic member 110A and the second metallic member 120A are spaced apart from each other by the first contact increasing portion 210A and the second contact increasing portion 220A. By increasing the contact area with the elastic member 130A to be injection-molded in a space between the first metallic member 110A and the second metallic member 120A, the movement of the blowing fan 50 can be reduced, and vibration and noise can be reduced.

As apparent from the above description, in accordance with embodiments of the present disclosure, it may be possible to improve the coupling and durability of a fan and a motor by the improved boss structure.

It may also be possible to reduce rotational vibration of a fan and reduce unsteadiness due to an external impact, thereby improving convenience of a user and stability of the product.

Although a few embodiments of the present disclosure have been shown and described, it is to be understood that the disclosure is not limited to the disclosed embodiments. It would be appreciated by those skilled in the art that changes may be made in these embodiments without departing from the principles and spirit of the invention, the scope of which is defined in the claims and their equivalents.

What is claimed is:

1. An air cleaner comprising:
a main body;
a blowing fan provided inside the main body;
a motor configured to drive the blowing fan; and
a boss configured to connect the blowing fan and the motor,
wherein the boss comprises:
a first metallic member connected to the blowing fan,
a second metallic member connected to the motor, and
an elastic member provided between the first metallic member and the second metallic member, wherein a portion of the elastic member surrounds an end of the first metallic member to contact both an inner circumferential surface and an outer circumferential surface of the first metallic member, and
wherein at least one of the first metallic member and the second metallic member includes a flange portion configured to provide the at least one of the first metallic member and the second metallic member with more contact area for contacting the elastic member.

2. The air cleaner according to claim 1, wherein the elastic member is injection-molded between the first metallic member and the second metallic member.

3. The air cleaner according to claim 1, wherein the flange portion includes a first flange portion integrally formed with the first metallic member.

4. The air cleaner according to claim 3, wherein:
the flange portion further includes a plurality of holes, and
the elastic member is injection-molded through the plurality of holes.

5. The air cleaner according to claim 3, wherein the first flange portion includes at least one bent portion protruding toward the motor.

6. The air cleaner according to claim 3, wherein the first flange portion includes a ring-shaped protrusion in which at least a portion of the first metallic member protrudes toward the motor.

7. The air cleaner according to claim 6, wherein the ring-shaped protrusion includes a plurality of holes.

8. The air cleaner according to claim 1, wherein the flange portion includes a second flange portion integrally formed with the second metallic member.

9. The air cleaner according to claim 8, wherein one side of an upper and a lower side of the second flange portion has a larger diameter than the other side.

10. The air cleaner according to claim 1, wherein the first metallic member and the second metallic member comprise aluminum.

11. The air cleaner according to claim 1, wherein the boss is coupled to the blowing fan by injection molding.

12. An air cleaner comprising:
a main body;
a blowing fan provided inside the main body;
a motor configured to drive the blowing fan; and
a boss provided in the blowing fan to be connected to the motor,
wherein the boss includes:
a first metallic member having a first flange portion protruding toward the motor;
a second metallic member connected to the motor and having a second flange portion protruding in a circumferential direction; and
an elastic member provided between the first metallic member and the second metallic member, wherein a portion of the elastic member surrounds an end of the first metallic member to contact both an inner circumferential surface and an outer circumferential surface of the first metallic member.

13. The air cleaner according to claim 12, wherein the elastic member is injection-molded between the first metallic member and the second metallic member.

14. The air cleaner according to claim 12, wherein:
the first flange portion includes a bent portion in which at least a portion of the first metallic member is bent and protrudes toward the motor, and a plurality of holes formed through the bent portion, and
the elastic member is injection-molded with the first metallic member through the plurality of holes.

15. The air cleaner according to claim 12, wherein the first flange portion includes a ring-shaped protruding portion in which at least a portion of the first metallic member protrudes toward the motor.

16. The air cleaner according to claim 15, wherein the ring-shaped protruding portion includes a plurality of holes.

17. The air cleaner according to claim 12, wherein one side of an upper and a lower side of the second flange portion has a larger diameter than the other side.

18. The air cleaner according to claim 12, wherein the first metallic member and the second metallic member comprise aluminum.

19. The air cleaner according to claim 12, wherein the second metallic member further includes a motor connecting portion to which the motor is connected, and
the second flange portion protrudes outside the motor connecting portion.

20. The air cleaner according to claim 12, wherein the boss is coupled to the blowing fan by injection molding.

* * * * *